US006516898B1

(12) United States Patent
Krueger

(10) Patent No.: US 6,516,898 B1
(45) Date of Patent: Feb. 11, 2003

(54) CONTINUOUS WELLBORE DRILLING SYSTEM WITH STATIONARY SENSOR MEASUREMENTS

(75) Inventor: Volker Krueger, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/632,529

(22) Filed: Aug. 4, 2000

Related U.S. Application Data

(60) Provisional application No. 60/147,533, filed on Aug. 5, 1999.

(51) Int. Cl.[7] ..... E21B 47/00; E21B 17/10

(52) U.S. Cl. ..... 175/50; 175/48; 175/230

(58) Field of Search ..... 175/40, 41, 48, 175/50, 230, 321; 324/303, 356, 369

(56) References Cited

U.S. PATENT DOCUMENTS 5,186,264 A * 2/1993 du Chaffaut ..... 175/27
6,247,542 B1 * 6/2001 Kruspe et al. ..... 175/40

FOREIGN PATENT DOCUMENTS

| | | |
|---|---|---|
| WO | WO 97/08418 | 3/1997 |
| WO | WO 97/15749 | 5/1997 |
| WO | WO 98/17894 | 4/1998 |
| WO | WO 99/00575 | 1/1999 |
| WO | WO 99/09290 | 2/1999 |
| WO | WO 99/45234 | 9/1999 |
| WO | WO 00/28188 | 5/2000 |

* cited by examiner

*Primary Examiner*—David Bagnell
*Assistant Examiner*—Jennifer R. Dougherty
(74) *Attorney, Agent, or Firm*—Madan, Mossman & Sriram, P.C.

(57) ABSTRACT

The present invention provides continuous or near continuous motion drill strings which include motion sensitive and other MWD sensors which take stationary measurements while the drilling assembly is continuing to drill the wellbore. For simultaneous continuous drilling and stationary measurements, the present invention provides a drilling assembly wherein a force application system almost-continuously applies force on the drill bit while maintaining a housing or drill collar section stationary. Motion sensitive sensors carried by the drill collar take stationary measurements. A steering device between the drill bit and the force application system maintains drilling of the wellbore along a prescribed well path.

48 Claims, 6 Drawing Sheets

CONTINUOUS WELLBORE DRILLING SYSTEM WITH STATIONARY SENSOR MEASUREMENTS

CROSS-REFERENCE TO RELATED APPLICATIONS

This application takes priority from U.S. patent application Ser. No. 60/147,533, filed Aug. 5, 1999.

BACKGROUND OF THE INVENTION

1. Field of the Invention

The present invention relates to a system for drilling wellbores and more particularly to drill strings that include a bottomhole assembly that has a force application system that continuously or almost-continuously applies force on the drill bit to provide for continuous drilling and further has at least one housing or collar, which remains stationary with respect to the wellbore inside during the continuous drilling process. A set of sensors whose measurements are sensitive to the axial movement of the bottomhole assembly are integrated into the collar, which sensors take measurements while the collar is stationary while the drilling is continuing. This invention also relates to a downhole thruster system that includes an integrated steering system for drilling the wellbore along a prescribed trajectory.

2. Description of the Related Art

Wellbores are drilled in subsurface formations to recover oil and gas. Drilling is usually performed by a drilling assembly (also referred to as the "bottomhole assembly" or "BHA") conveyed into the wellbore by a tubing, usually a coiled tubing or a jointed pipe tubing. The BHA contains a drill bit at the bottom end of the BHA. The drill bit is rotated by a mud motor in the BHA and/or by rotating the drill pipe from the surface. For effective penetration of the drill bit into the formation, weight on bit ("WOB") must be maintained within an acceptable range. Excessive WOB can cause the drill bit to become wedged in the wellbore bottom or damage the mud motor and other BHA components, while relatively small WOB can reduce the drilling rate or the rate of penetration ("ROP") to a level which impairs drilling effectiveness.

A thruster in the drill string (usually a part of the BHA) is sometimes used to apply force on the drill bit and to maintain and control the desired WOB. Such thrusters usually are hydraulically-operated. A thruster usually has a housing connected to the drill pipe and a mandrel or piston connected to the lower part of the BHA. The hydraulic pressure generated in the BHA is applied to the piston, which moves the piston axially (i.e. along the wellbore axis) thereby applying force and thus WOB on the drill bit during the drilling process.

There are basically two methods utilized for drilling with the hydraulic axial force generated by a thruster: The first case is when the drill pipe above the thruster can be continuously lowered, i.e., moved into the wellbore. If the axial stick slip motion of the drill pipe does not exceed the available travel distance of the piston, then the drill pipe is continuously lowered. The rate of lowering the drill pipe must, however, be the same as the rate of penetration of the drill bit into the rock formation. The second case is when the stick slip motion is such that it intermittently causes the thruster to fully extend and then collapse, then the so-called "stepwise" process is more appropriate. During the stepwise process each time after the piston has been fully, it shifted into the initial or the collapsed position lowering of the drill pipe. The thruster piston is continuously extended to drill the wellbore until the piston is fully extended. The drill string is then lowered by the travel distance of the piston and the process is repeated. This method can be aided by stopping and starting the pumps or at least lowering the drilling fluid flow rate and subsequently resuming the rate to the normal level. The stepwise process allows drilling under different stick slip conditions but has the disadvantage of changes of the feeding rate of the drill pipe and also, potentially, changes of the flow rate.

In order to further reduce the stick slip effects on the drilling assembly, to eliminate the reactive force on the drill pipe, and to dynamically uncouple the drill string from the BHA, the thruster can be combined with a locking device that connects the upper part of the thruster to the drill pipe. The same stepwise process for moving or lowering the drill pipe would be applied with the additional locking and unlocking of the thruster top-end or with the drill pipe positioned on top of the thruster to the borehole wall. Stopping and starting the pumps provides the additional advantage of applying only the axial force to the drill bit which is needed to axially move the drill pipe without the need to apply the incrementally larger force to create the WOB.

It is desirable to have thruster systems which can continuously apply force on the drill bit and carry out downhole measurements. International Application No. WO 99/09290 describes a drill string with a thruster system for drilling wellbores. Such a system, however, does not allow for continuous drilling of the wellbore. International Patent Application No. WO 97/08418 describes a drill string which includes two serially coupled thrusters which cooperate with each other to substantially continuously apply force on the drill bit but does not provide the desired downhole sensors. The trend in the oil drilling industry has been to incorporate a variety of sensors in the drilling assembly to take a variety of measurements-while-drilling the wellbore. Such sensors are usually referred to as measurement-while-drilling or ("MWD") devices. Logging devices, such as formation resistivity sensors, acoustic sensors, etc., are sometimes referred to as the logging-while-drilling or ("LWD") sensors. For the purpose of this invention, the terms MWD and LWD are used interchangeably.

It is known that some of the MWD measurements are relatively sensitive to motion, i.e., it is either preferable or necessary to make such measurements while such sensors are not moving in the wellbore. For the purpose of this invention, such measurements are referred to as the motion sensitive measurements. Additionally, it is preferable to have a continuous motion drill string that can be steered downhole so as to drill the wellbore along a preselected or desired well path. Such a steering system may be a closed loop system based on a preprogrammed well trajectory or wherein the drilling course is adjusted by sending commands from the surface. The present invention provides a drilling system wherein a thruster system continuously or near continuously applies force on the drill bit while allowing the motion sensitive sensors to make stationary measurements. The present invention further incorporates a steering device for automatically maintaining the drilling along a prescribed well path.

SUMMARY OF THE INVENTION

The present invention provides continuous or near continuous motion drill strings which include motion sensitive and other MWD sensors which take stationary measurements while the drilling assembly is continuing to drill the wellbore. For simultaneous continuous drilling and stationary measurements, the present invention provides a drilling assembly wherein a force application system almost-continuously applies force on the drill bit while maintaining a housing or drill collar section stationary. Motion sensitive sensors carried by the drill collar take stationary measurements. A steering device between the drill bit and the force application system maintains drilling of the wellbore along a prescribed well path.

To drill a wellbore, the drilling assembly of the present invention is conveyed by a tubing into the wellbore from a surface location. The drilling assembly, in one embodiment, includes two serially coupled thrusters, each having a housing that can be locked on to the wellbore and a force application member that can be moved from a first retracted position to a second extended position. The housing of the first force application device is locked in the wellbore. The force application member moves from the retracted position to the extended position applying force on the drill bit, which causes the drill bit to penetrate the formation. The force application member continues the application of the force until it is fully extended. The second force application device is then locked onto the wellbore and the first force application device unlocked from the wellbore. The second force application device applies pressure on the first force application member, causing it to move to its retracted position. After the first force application member has moved to its retracted or collapsed position, it is again locked to the borehole wall and the second force application is unlocked from the borehole. Either by continuously lowering of the drill pipe or through a stepwise lowering of the second force application member, the first force application member is then moved into its retracted position. The above process is repeated to continue the drilling process. The force applied on the drill bit by the first force application device may be constant and continuous.

In an alternative embodiment, a single continuous motion traction device is utilized to continuously apply force on the drill bit. A housing above or uphole of the continuous motion traction device remains stationary with respect to the wellbore for a predetermined travel of the traction device. In each of the drilling assemblies according to the present invention, at least one housing or drill collar remains stationary relative to the wellbore, while drilling continues. One or more motion sensitive sensors are provided on one or more of the housings of the force application system. Such sensors take measurements when the housing carrying such sensors is stationary. The present invention preferably integrates such sensors into the housings. Such sensors include a nuclear magnetic resonance sensor which is particularly susceptible to movement. The stationary housing can provide a stable platform for such sensors. Other sensors that can be integrated include a direction measuring sensor or directional sensor system, which would include at least one or more accelerometers and at least one gyroscope or a magnetometer. The combination of the measurements from the accelerometers and the gyroscopes or the magnetometers provide full directional measurement capability. Preferably three axis accelerometers are used in the directional sensor of the present invention. An acoustic sensor system may be incorporated in one of the housings. Such a sensor system would include at least one transmitter and one or more acoustic detectors spaced apart from the transmitter. Acoustic sensors provide porosity measurements and bed bound any information. A nuclear sensor may be incorporated into a housing of the present system to determine the density and the nuclear porosity of the formation surrounding the wellbore. A formation testing device usually requires extracting a fluid sample from the formation which requires the tool to remain stationary. In the present invention, a formation testing device is included in one of the housings. The above described sensors tend to be particularly sensitive to the axial movement of the sensor. However, other sensors, such as a pressure sensor may be used to determine the reservoir pressure. Stabilizers may be incorporated in the housings to reduce the vibration of the housings, thereby providing more stable platform for the motion sensitive sensors.

Thus, the present invention provides a drilling assembly that continuously exerts force on the drill bit to cause the drill bit to continuously drill the well while making selected measurements in a stationary mode. A variety of other sensors may also be incorporated into the housings and/or in other sections of the drilling assembly.

The continuous motion drilling assembly of the present invention, in one embodiment, also includes a steering device, preferably below or downhole of any thruster in the drilling assembly. Such a steering device includes one or more independently adjustable force application members or ribs. Each such member extends outward from the drilling assembly to apply selected amount of force on the wellbore wall. A control unit controls the applied force to maintain the drilling assembly along a presented or predetermined well trajectory or path.

Each embodiment of the drilling assembly of the present invention preferably includes a processor (also referred to as the "control unit" or a "processing unit") that includes one or more microprocessor-based circuits to process measurements made by the sensors in the drilling assembly at least in part, downhole during drilling of the wellbore. The processed signals or the computed results are transmitted to the surface by a telemetry unit in the drilling assembly. The desired downhole trajectory may be programmed into a memory of the processor. The processor then controls the force applied by the force application members to steer the drilling assembly along the prescribed well path. The processor also controls the operation of the sensors and other devices in the drilling assembly.

Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE PREFERRED EMBODIMENT

The present invention provides drill strings for drilling wellbores that include a drilling assembly (also referred herein as the bottom hole assembly or "BHA") at its bottom end. The BHA includes a drilling motor that rotates a drill bit and a force application system that continuously or substantially continuously applies force on the drill bit to provide substantially continuous drilling of the wellbore. The reactive force from drilling is directed into the borehole at a location above or uphole of the BHA instead of the drill pipe. The force application system includes at least one housing or drill collar that remains stationary relative to the wellbore at least periodically while the drilling assembly is penetrating the formation, i.e. moving downhole. One or more motion sensitive sensors carried by one or more housings provide measurement data or signals indicative of one or more downhole parameters when the housing is stationary and the drilling assembly is moving in the wellbore. The one or more sensors preferably are those whose measurements tend to provide more accurate results when such sensors are stationary compared to when such sensors are moving. Such sensors are referred herein as the "motion sensitive sensors." In a preferred embodiment, a steering device disposed in the drilling assembly near the drill bit can maintain the drilling assembly along a prescribed or predetermined well path. The drilling assembly includes one or more processors that control the operation of the sensors and the steering device downhole and process sensor data, at least partially.

Figure 1:
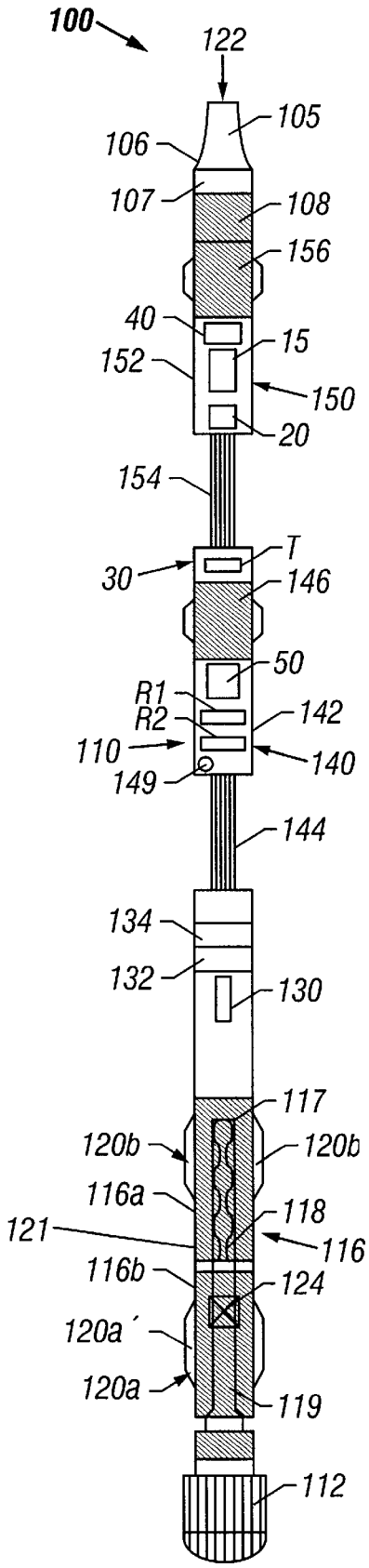
FIG. 1 show a schematic diagram of a drill string having a drilling assembly with two force application devices that alternately apply substantially constant force on the drill a plurality of motion sensitive sensors carried by the force application devices that provide measurements while a force application device not applying force on the drill bit.

FIG. 1 show a schematic diagram of one embodiment of a drill string 100 according to the present invention which includes a drilling assembly 110 that contains (i) force application system that includes two force application devices 140 and 150 in series that alternately operate to provide continuous or substantially continuous drilling of the wellbore and maintain at least one housing stationary relative to the wellbore while the drilling is continuing, and (ii) a plurality of motion sensitive sensors carried by the housings of the force application devices to provide measurements while such housings are stationary.

The drilling assembly 110 is attached to a drill pipe 105 at bottom end 106 of the drill pipe by a suitable connector 107. The drill pipe 105 is made by joining solid pipe sections, usually 30–40 feet long, at the rig site or surface. A coupling or swivel 108 between the drill pipe 105 and the drilling assembly 110 selectively allows the rotating drill pipe 105 to engage with or disengage from the drilling assembly 110. This allows the drilling assembly 110 to be non-rotational while allowing the drill pipe to be rotated from the surface to reduce friction losses. In the engaged mode, the drilling assembly 110 rotates when the drill pipe 105 rotates and in the disengaged mode, the rotation of the drill pipe 122 does not rotate the drilling assembly 110.

The drilling assembly 110 carries a drill bit 112 at its bottom end. A drilling motor 116 disposed above or uphole of the drill bit 112 rotates the drill bit 112. The drilling motor 116 is preferably a positive displacement motor that operates when a fluid 122 (such as the drilling fluid or "mud") is supplied under pressure from a surface location to the drill pipe 105. Such motors are also referred to in the art as "mud motors." A mud motor usually includes a power section **116*a* and a bearing assembly section 116*b*. The power section 116*a* includes a rotor 117 that is rotatably disposed in a stator 118. When the drilling fluid 122 is supplied to the drilling motor 116 under pressure from the surface or the well site, the rotor 117 rotates in the stator 118. The rotor 117 rotates a hollow shaft 119 whose bottom end is fixedly connected to the drill bit 112, thereby rotating the drill bit 112. The shaft 119 extends through the bearing assembly section 116*b*. The bearing assembly section 116*a* includes radial and axial bearings (not shown) which respectively provide lateral and axial stability to the drill shaft 119 during drilling of the wellbore. Drilling motors are in common use in the oil and gas industry and are, thus, not described herein in detail. Any suitable drilling motor, whether a mud motor or a turbine or any other kind may be utilized in the drilling assembly 110** of the present invention.

Still referring to FIG. 1, the drilling assembly 110 includes a lower or the first force application device 140 (also referred to herein as the "lower thruster" or the "first thruster") and an upper or second force application device 150 (also referred to herein as the "upper thruster" or the "second thruster"). The upper thruster 150 is disposed above or uphole of the lower thruster 140. The lower thruster 140 includes a housing 142 (also referred to as a drill collar or drill collar portion) wherein a force application member 144 reciprocates in the thruster 140 between a first (also referred to as the initial or the retracted position) and a second (also referred to as the extended) position. The force application member 144 may be a piston that reciprocates in a piston chamber in the thruster 140 upon the supply of a fluid under pressure to the chamber. A number of mechanical thrusters for supplying axial force have been utilized in drilling applications. U.S. patent application Ser. No. 09/271,947, filed on Mar. 18, 1999 discloses a hydraulically-operated mechanical thruster that can apply constant or variable force on to the drill. U.S. patent application Ser. No. 09/271,947, directed to a thruster system, assigned to the assignee of this application, is incorporated herein by reference. The thrusters disclosed in this application or any other mechanical thruster may be utilized in the drilling assembly 110 as the lower thruster 140.

A locking device 146 is disposed on the periphery of the thruster housing 142. The locking device 146 may be an expandable packer or a mechanical anchor or any other suitable device that can be extended radially outward from the thruster housing 142 to lock the thruster housing 142 onto the wellbore inside and retracted to unlock or detach the thruster housing 142 from the wellbore inside. A hydraulically-operated device, such as a packer, is the preferred locking device in the drilling assembly 110. When the lower thruster 140 is locked in position and a fluid under pressure is supplied to the thruster, the force application member 144 starts to extend axially downward or in the downhole direction, i.e., it starts to move toward the drill bit 112, thereby exerting force on the drill bit 112. The thruster 140 may be configured to apply a constant or a variable amount of force on the drill bit 112 during drilling of the wellbore.

The upper thruster 150 has a body or housing 152 and a second force application member 154. A second locking device 156 is provided on the upper thruster 150 which can releasably lock the upper thruster housing 152 in the wellbore. When the upper thruster housing 152 is locked onto the wellbore and pressure is applied on the force application member 154, it starts to move downward, exerting pressure on the lower thruster 140, which causes the force application member 144 of the lower thruster to collapse or retract to its initial position. The upper thruster 150 may be the same type as the lower thruster 140 or it may be any other type of force application device that is adapted to exert pressure on the lower thruster to cause the force application member 144 of lower thruster 140 to move from its extended position to its retracted position downhole.

The drilling assembly 110 further may include one or more independently adjustable stabilizers, such as stabilizers 120*a* and 120*b*, near the drill bit 112 for maintaining and/or changing the drilling direction. These stabilizers preferably include a plurality of radially extendable members (also referred to herein as "ribs"), each such member being adapted to independently exert force on the wellbore. Preferably, the lower stabilizer 120*a* is arranged around the drilling motor section 116 near the drill bit 112 and spaced apart from the upper stabilizer 120*b* which is disposed near the upper end of the drilling motor section 116. These stabilizers also provide lateral support and stability to the drilling assembly 110, which reduces the vibration effects during drilling of the wellbore. Each adjustable member 120*a'* and 120*b'* is independently controlled by the downhole controller 132. Such force application members are preferably hydraulically-operated, but may be operated by electric motors or electromechanical devices. The desired wellbore trajectory may be stored in downhole memory. The controller 132 adjusts the force applied by the force application members 120*a'* and 120*b'* so that drilling direction is maintained along the prescribed or predetermined well trajectory or path.

Still referring to FIG. 1, the drilling assembly 110 includes a number of sensors and devices which aid the drilling operation and provide information about the subsurface formations. The drilling assembly 110 may include any number of sensors to provide measurements about the drilling direction and the location or depth of the drill bit 112 or the drilling assembly relative to a known location, such as a surface location or true north. Such sensors may include inclinometer, accelerometers, magnetometers and gyroscopic devices. Nuclear sensors, such as gamma ray devices, may also be utilized. In FIG. 1, some of such sensors are denoted by numeral 124 and are shown disposed in the mud motor 116. A variety of position and direction sensors are known and are commercially utilized in the oil and gas industry and are thus not described in detail here.

The drilling assembly 110 includes a number of formation evaluation sensors for providing information about the various characteristics of the formation, directional sensors for providing information about the drilling direction, formation testing sensors for providing information about the characteristics of the reservoir fluid and for evaluating the reservoir conditions. The formation evaluation sensors may include resistivity sensors for determining the formation resistivity, dielectric constant and the presence or absence of hydrocarbons, acoustic sensors for determining the acoustic porosity of the formation and the bed boundary in formation, nuclear sensors for determining the formation density, nuclear porosity and certain rock characteristics, nuclear magnetic resonance sensors for determining the porosity and other petrophysical characteristics of the formation. The direction and position sensors preferably include a combination of one or more accelerometers and one or more gyroscopes or magnetometers. The accelerometers preferably provide measurements along three axes. The formation testing sensors provide a device for collecting formation fluid samples while drilling of the wellbore is continuing and determines the properties of the formation fluid, which include physical properties and chemical properties. Pressure measurements of the formation provide information about the reservoir characteristics.

It is known that some of the above described sensors are sensitive to motion, i.e., such sensors provide more accurate information about the intended parameters if the measurements are made when the sensor is stationary compared to when the sensor is moving in the wellbore. In the prior art methods such sensors either take measurements while the drilling assembly is in motion or the drilling is temporarily stopped to make the measurements. In the present invention the motion sensitive sensors are preferably placed in the housings 142 and 152 of the force application devices 140 and 150, respectively. These sensors are activated when the housing carrying such sensors is stationary relative to the wellbore. Nuclear magnetic resonance sensors can be greatly affected by motion. Nuclear sensors and acoustic sensor measurements also are affected by motion. It is also preferred that gyroscopic measurement be made when the tool is stationary. Formation testing sensors can not be used in motion as fluid samples must be withdrawn from the formation by placing a probe against the wellbore wall for a period of time. In the present invention, one or more of the motion sensitive sensors are carried by the sections of the drilling assembly 110 that will remain stationary for a period of time while the drilling is continuing. In the embodiment of FIG. 1, such sensors may be placed in one or both of the housings 142 and 152. Some of such sensors, however may be placed in other sections of the drilling assembly. They also may be integrated in the mud motor 116.

Figure 1A:
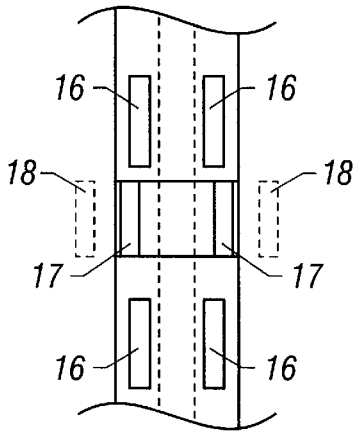
FIGS. 1A–1D shows functional block diagrams of selected motion sensitive sensors for use in the drilling assemblies made according to the presented invention.

Still referring to FIG. 1, the drilling assembly 110 is shown to include a nuclear magnetic resonance ("NMR") sensor 15 in the upper housing 152. Any suitable NMR sensor may be utilized for the purpose of this invention. FIG. 1A shows a structure of an NMR sensor 15 that may be incorporated in the drilling assembly 110. The NMR sensor 15 includes a magnet system 16 that induces a static magnetic field and a region of investigation 18 in the formation. A radio frequency ("RF") antenna 17 produces radio frequency signals orthogonal to the static magnetic field in the region of investigation 18. A control circuit (not shown) processes the radio frequency signals detected in response to the RF signals to determine a property of the formation.

Figure 1B:
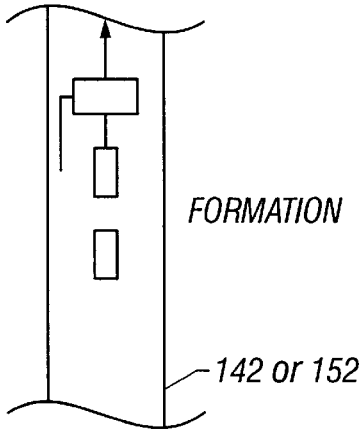

A nuclear sensor 20 is shown carried by the upper housing 152. Referring to FIG. 1B, the nuclear sensor 20 includes a nuclear source 21 which generates nuclear energy into the formation surrounding the drilling assembly 110. A detector 22 detects the nuclear rays from the formation responsive to nuclear energy generated by the nuclear source 21. A processor 24 processes the detected rays to determine the nuclear porosity and the density of the formation.

An acoustic sensor 30 is shown carried by the lower housing 142. It includes an acoustic transmitter T that generates acoustic signals in the formation surrounding the wellbore. One or more acoustic detectors such as R1 and R2 placed spaced apart from the transmitter T detect acoustic signals propagated through the formation as well as signals reflected from reflection points in the formation in response to the transmitted signals. A processor, such as processor 132 processes the detected signals to determine a characteristic of the formation, such as the acoustic velocity of the formation and the bed boundary information.

Figure 1C:
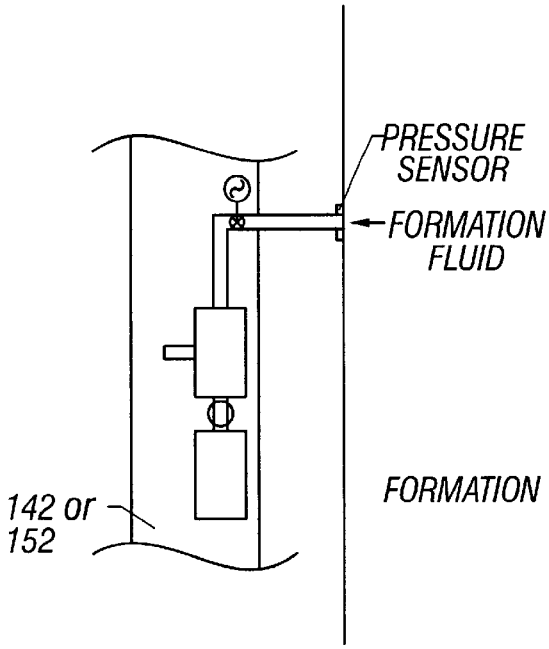

A formation tester 40 is shown carried by the upper housing 152. FIG. 1C, shows a functional block diagram of an exemplary formation testing device that includes a probe 41 for collecting formation fluid, which passes through a chamber 42. One or more sensors, such as sensor 43, provides in-situ information about one or more properties of the collected fluid. Such properties may include a chemical property of the fluid, composition of the collected fluid and/or a physical property of the collected fluid. A sample collection chamber 45 can be used to collect the sample under formation conditions for laboratory testing. A pressure sensor 46 in the probe or at any other suitable location provides the pressure of the formation.

Figure 1D:
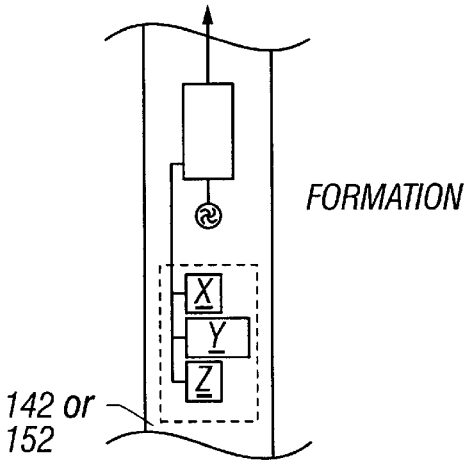

A direction measuring sensor 50 is shown carried by the lower housing 142. FIG. 1D shows a block functional diagram of an exemplary directional sensor 50. It preferably includes a three component accelerometer 51 which provides acceleration measurements along the three axes (x, y, and z axes) and one or more gyroscopes or magnetometers 52. The measurements of the accelerometer and the gyroscope or the magnetometer are combined to determine the direction of the drilling assembly.

The drilling assembly 110 includes one or more downhole controllers or processors, such a processor 132. The processor 132 can process signals from the various sensors in the drilling assembly and also controls their operation. It also can control devices , such as devices 120*a,* 120*b* and 130. A separate processor may be used for each sensor or device. Each sensor may also have additional circuitry for its unique operations. The downhole controller is used herein in the generic sense for simplicity and ease of understanding and not as a limitation because the use and operation of such controllers is known in the art. The controller 132 preferably contains one or more microprocessors or micro-controllers for processing signals and data and for performing control functions, solid state memory units for storing programmed instructions, models (which may be interactive models) and data, and other necessary control circuits. The microprocessors control the operations of the various sensors, provide communication among the downhole sensors and provide two-way data and signal communication between the drilling assembly 110 and the surface equipment via a two-way telemetry 134.

Figure 3:
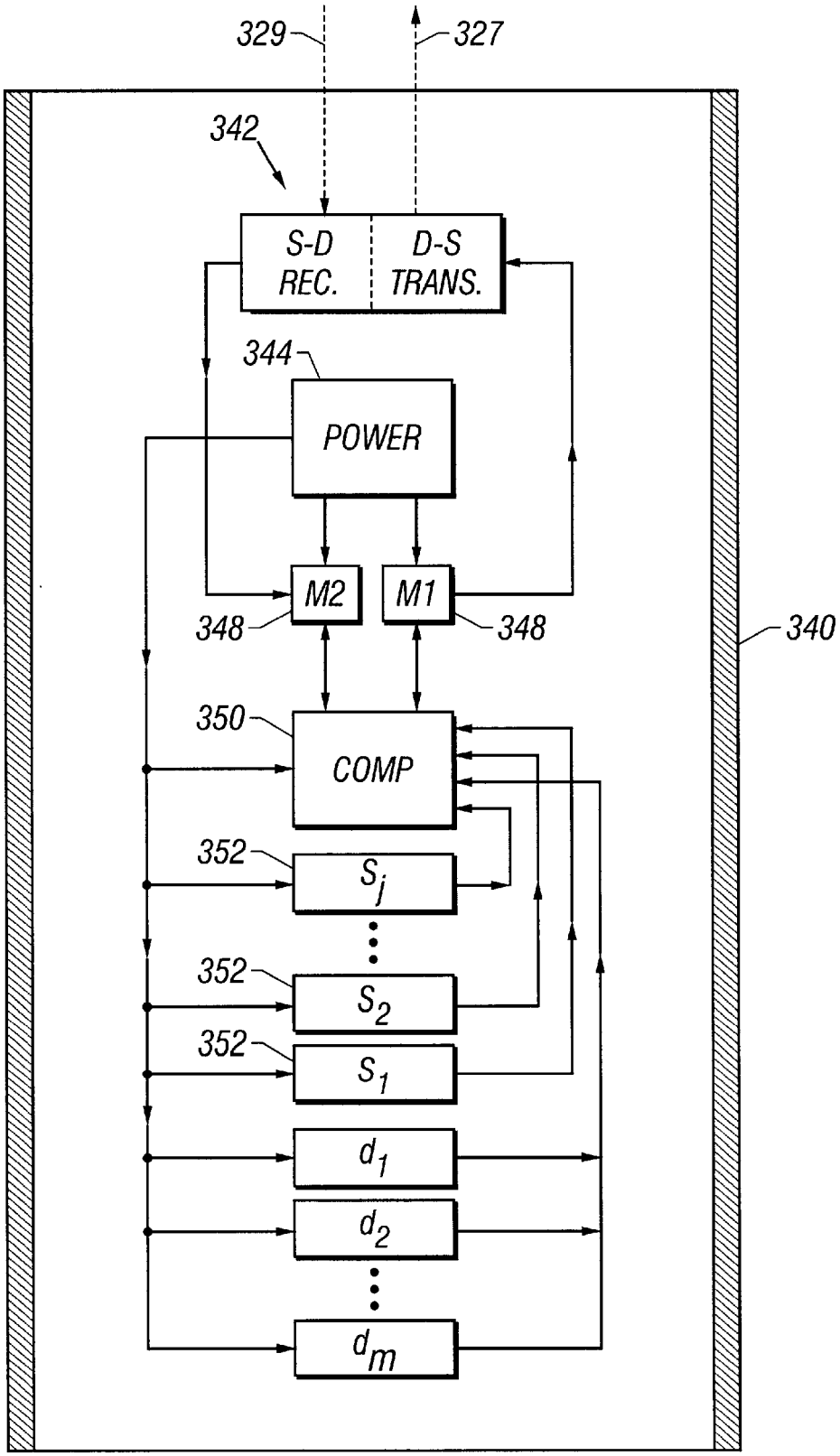
FIG. 3 shows an exemplary block functional diagram of a processor for processing measurement signals from the sensor in the drilling assemblies made according to the present invention.

FIG. 3 shows an exemplary functional block diagram 340 of the major elements of the bottom hole assembly 110 of FIG. 1 and further illustrates with arrows the paths of cooperation between such elements. It should be understood that FIG. 3 illustrates only one arrangement of certain elements and one system for cooperation between such elements. Other equally effective arrangements may be utilized to practice the invention. A predetermined number of discrete data point outputs from the sensors 352 ($S_1$–$S_j$) are stored within a buffer which, in FIG. 3, is included as a partitioned portion of the memory capacity of a computer 350. The computer 350 preferably comprises commercially available solid state devices which are applicable to the borehole environment. Alternatively, the buffer storage can comprise a separate memory element (not shown). The interactive models are stored within memory 348. In addition, other reference data such as calibration compensation models and predetermined drilling path also are stored in the memory 348. A two way communication link exists between the memory 348 and the computer 350. The responses from sensors 352 are transmitted to the computer 350 and or the surface computer 40 (see FIG. 6) wherein they are transformed into parameters of interest using known methods.

The computer 350 also is operatively coupled to certain downhole controllable devices $d_1$–$d_m$, such as thrusters 140 and 150, adjustable stabilizers 120*a* and 120*b* and kick-off subassembly for geosteering and to a flow control device for controlling the fluid flow through the drill motor for controlling the drill bit rotational speed.

The power sources 344 supply power to the telemetry element 342, the computer 350, the memory modules 346 and 348 and associated control circuits (not shown), and the sensors 352 and associated control circuits (not shown). Information from the surface is transmitted over the downlink telemetry path illustrated by the broken line 329 to the downhole receiving element of downhole telemetry unit 342, and then transmitted to the storage device 348. Data from the downhole components is transmitted uphold via link 327. In the present invention, the parameters of interest such as toolface, inclination and azimuth are preferably computed downhole and only the answers are transmitted to the surface. The formation evaluation measurements may be partially of fully processed downhole and stored for later use or transmitted to the surface.

Figure 2A:
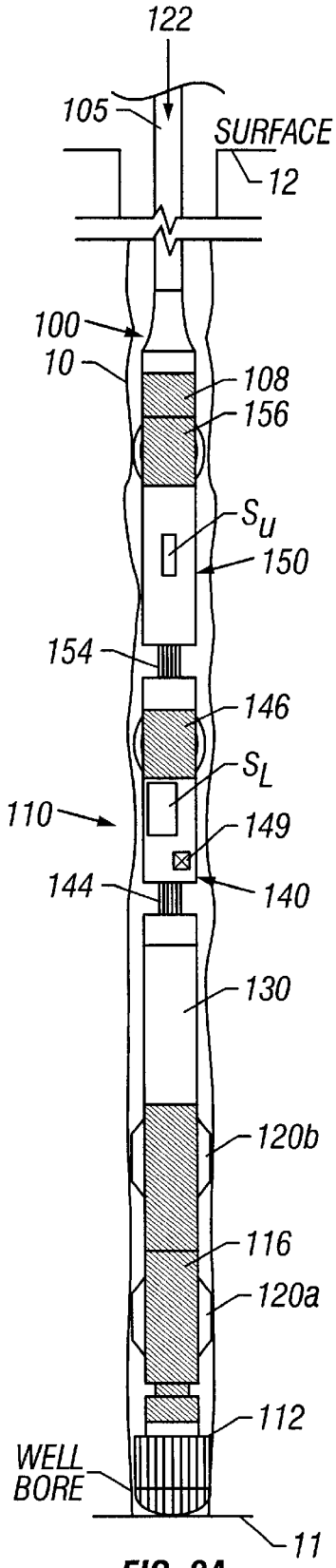
FIGS. 2A–2D depict sequence of operation during one cycle of the operation of the force application members of the drilling assembly of FIG. 1.

The operation of the drilling assembly of FIG. 1 will now be described in reference to FIGS. 2A–2D, which depict the sequence of operation during one cycle of operation of the force application system 140 and 150. FIG. 2A shows the drill string 100 extending from a surface location 12 and terminating with the drill bit 112 at the bottom 11 of a wellbore 10. Drilling fluid 122 is continuously supplied under pressure from a source thereof (see FIG. 6) at the surface 12 to the drilling assembly 110 via the drill pipe 105. The drilling fluid 122 rotates the rotor 119 of the mud motor 116, which rotates the drill bit 112.

Figure 2B:
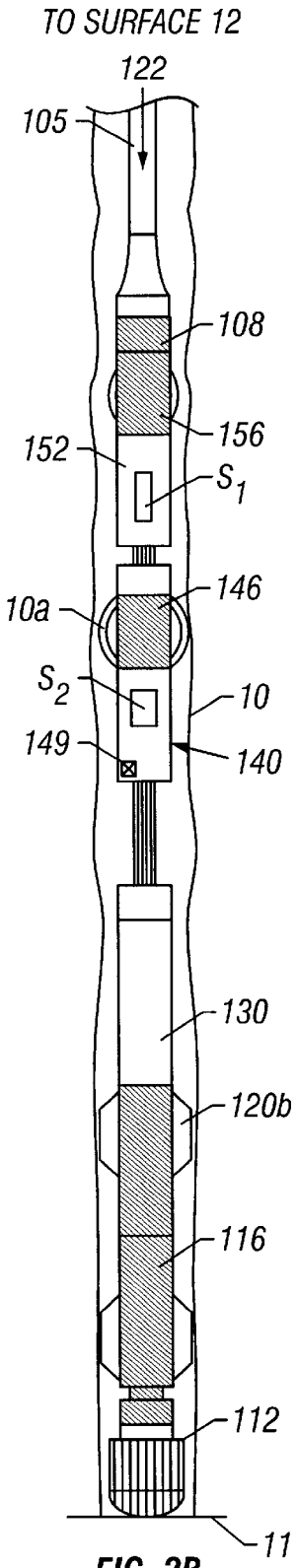
Figure 2C:
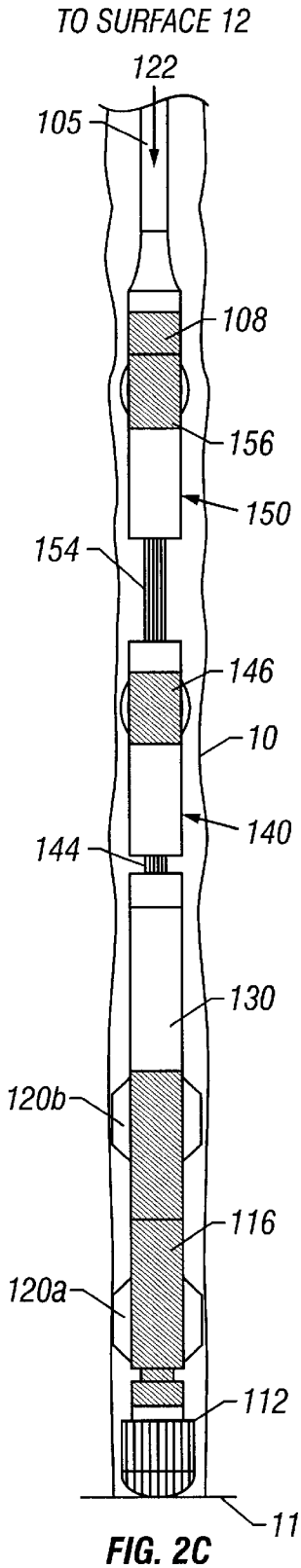
Figure 2D:
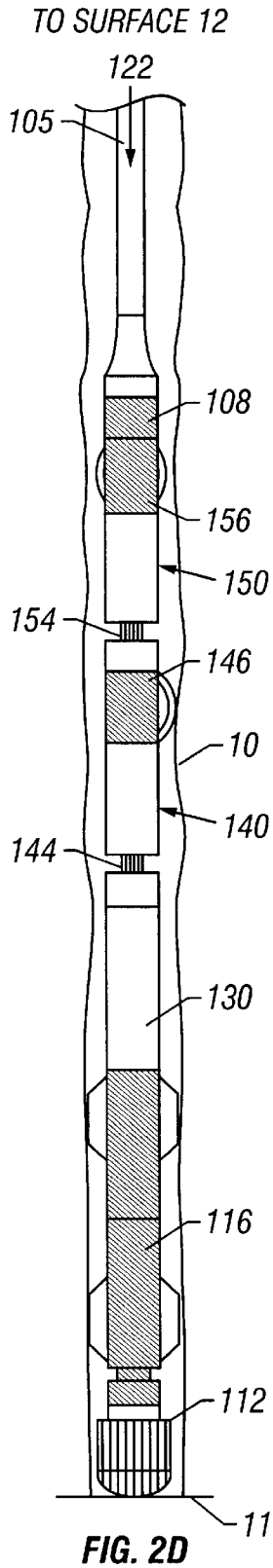

To drill the wellbore 10, the lower locking device 146 is set or expanded to lock the lower thruster 140 in the wellbore 10 at location 10*a* (see FIG. 2B). Pressure is supplied to the thruster 140, which causes the force application members 144 to move downward, thereby exerting force on the drill bit 112. The drilling motor continuously rotates the drill bit 112 while the lower thruster 140 is exerting force on the drill bit 112. The lower thruster 140 may be configured to apply constant force on the drill bit 112 regardless of the rate of penetration of the drill bit 112 into the formation 10 or it may be configured to apply variable force based on drilling factors. A sensor 149 may be provided in the thruster to determine the travel distance of the force application member 146 and the rate of penetration. Once the force application member 144 has fully extended or extended by a desired distance (as determined by the sensor 149), as shown in FIG. 2B, the lower locking device 146 is retracted or collapsed to release or unlock the lower thruster 140 from the wellbore 10, while the upper locking device 156 is expanded to lock the upper thruster 150 in position. As the upper thruster body is locked in the wellbore 10, the force application member 154 of the upper thruster 150 starts to move downward, causing the lower thruster body 142 to move toward the drill bit 112, thereby causing the lower thruster's force application member 144 to return to its initial or retracted position, as shown in FIG. 2C. The lower locking device 146 is then engaged with or locked onto the wellbore 10 and the upper locking device 156 is disengaged from the wellbore 10. The drill pipe 105 is pushed downhole by the length of the stroke or the travel distance of the lower force application member 144, completing one cycle of operation of the thruster 140. The drilling is continued by repeating the process described above. The drill pipe sections are added while the drilling of the wellbore is in progress, since the drill string 100 itself is not used to provide the desired WOB. A coiled tubing may be used instead of the drill pipe.

When the lower thruster body 142 is locked onto the wellbore, both thruster housings 142 and 152 are stationary and remain such until the force application member has been fully extended. The sensors $S_L$ carried by the lower thruster housing 142 and the sensors $S_u$ carried by the upper thruster housing are activated to take measurements. For ease of explanation $S_L$ represents any or all of the sensors utilized in the upper housing while $S_u$ represents any or all of the sensors utilized in the lower housing 142. The measurements taken by the sensors $S_L$ and $S_u$ are processed by a downhole controller as described above. When the upper housing 152 is locked in position in the wellbore 10, the upper housing remains stationary while the lower housing 142 moves. During this time, sensors $S_L$ take measurements. It should be noted that the sensors $S_L$, $S_u$ and other sensors are capable of taking measurements while they are in motion and may be activated to take measurements continuously, except that certain sensors, such as the sample collection-type sensors described above need to be operated when they are stationary. Thus, the above described process provides substantially continuous application of force on the drill bit, thereby providing substantially continuous drilling of the wellbore, while allowing stationary measurements of the motion sensitive sensors. Additional stabilizers may be used on the housings to reduce the vibration effects caused by the drill bit motion.

Thus, the above-described system and method of the present invention utilizes a drill pipe drill string, wherein a mud motor rotates the drill bit and a thruster system continuously or near continuously applies constant force on the drill bit. Constant force applied to the drill bit and the continuous motion of the thruster piston significantly reduce the vibration of the drill string. The drill pipe may be rotated during drilling by disengaging the swivel 108 from the drilling assembly 110 for hole cleaning, to reduce friction, and to avoid the drill pipe becoming wedged in the wellbore.

Figure 4:
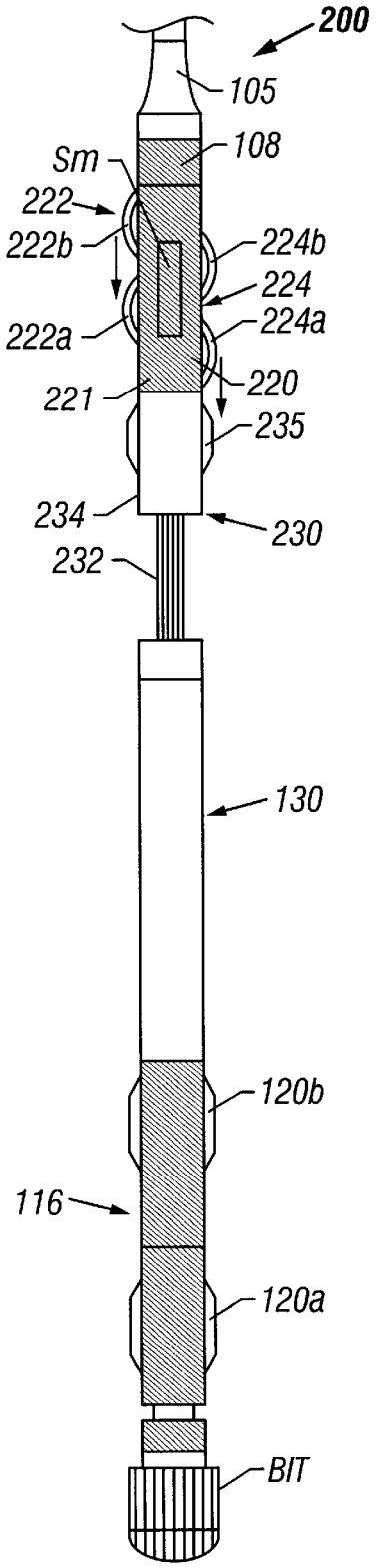
FIG. 4 shows an embodiment of a drilling assembly having a single force application member for continuously applying substantially constant force on the drill bit.

FIG. 4 shows an alternative embodiment of a drilling assembly 200 for continuously applying force on the drill bit according. The drilling assembly 200 is similar to the drilling assembly 100 of FIG. 1, but includes a tractor or traction device 220 for providing continuous force on the drill bit 112. The tractor 220 has a traction device that includes traction members 222 and 224. The traction member 222 has traction elements 222*a* and 222*b* that generate downward force while urging against the wellbore inside. Traction member 224 includes traction elements 224*a* and 224*b* which operate in the same manner as the traction elements 222*a* and 222*b*. The traction members 222 and 224 continuously apply force on the drill bit. The downward motion of the tractor 220 is the same as the rate of penetration of the drill bit 112 into the formation. The traction elements may be rollers or an endless track that can be continuously moved by gears or rollers.

In some applications, the traction device 220 may not be able to apply constant force on the drill bit 112. For such applications, a thruster 230, which may be the same type as the thruster 140 shown in FIG. 1, can be provided below the traction device 220 to exert constant force on the drill bit 112. In such a configuration, the traction device 220 provides pressure to collapse the thruster 230 from its extended position to its initial position during each cycle of operation. In this configuration, the tractor housing 221 and the thruster housing 235 remain stationary during the time thruster 230 is locked onto the wellbore inside. The motion sensitive sensors carried by such housings, generally denoted by $S_m$, take measurements while such housings are stationary. These measurements are processed in the manner described earlier.

Figure 5:
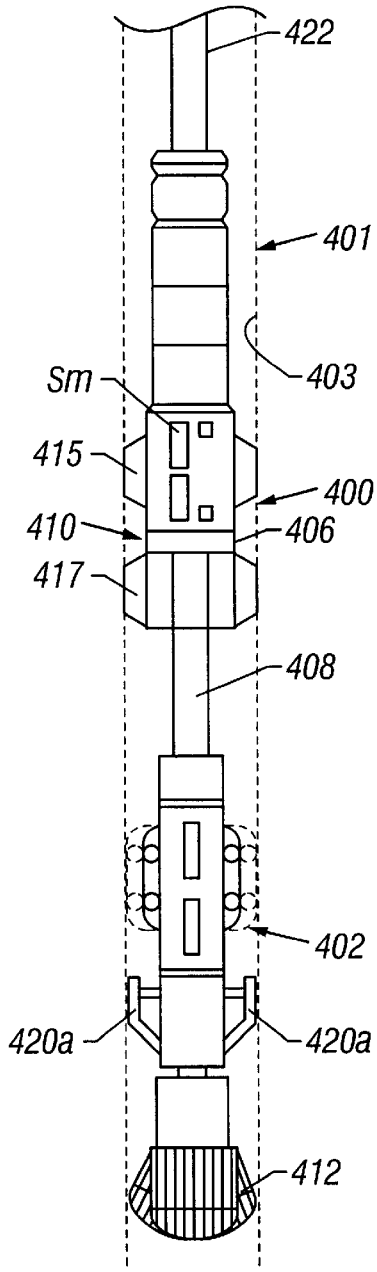
FIG. 5 shows an embodiment of a drilling assembly that includes a single force application device for continuously applying force on the drill bit and a drill collar carrying one or more motion sensitive sensors which remain stationary while the drill bit penetrates a preselected distance into the formation.

FIG. 5 shows yet another embodiment of a drilling assembly 400 placed in a wellbore 401. The drilling assembly 400 includes a traction device 402 that continuously applies force on the drill bit 412. A slidable housing 406 that can be locked onto the wellbore inside 403 is provided above the traction device 402. The lockable housing 406 may be a part of a thruster 410 such as described in FIG. 1. At the start of the operation, the piston 408 of the thruster 410 is in the collapsed position. The housing 406 is locked onto the wellbore 401 by a stabilizer or anchor 415. Additional stabilizers or anchors, such as stabilizer 417, may be used to reduce the effect of drill bit vibrations. When the housing 406 is locked in position, the traction device 402 applies force on the drill bit until the piston 408 fully extends, as shown in FIG. 4. The motion sensitive sensors $S_m$ carried by the housing 406 take measurements during the time the housing 406 is locked on to the wellbore 401. Once the piston 408 has fully extended, the housing 406 is unlocked from the wellbore 401 by retracting the stabilizers 415 and 417. The tubing 422 is then pushed down by a length equal to the travel distance of the piston 408, thereby causing the piston 408 to attain its initial collapsed position. The above process is then repeated. A steering device 420, having independently adjustable ribs 420*a*, is placed below the traction device to steer the drilling assembly along the desired wellbore path.

Thus, in the above described exemplary embodiments of the drilling assembly, a housing or drill collar is maintained stationary relative to the wellbore while continuously or nearly continuously applying force on the drill bit to obtain substantially continuous drilling of the wellbore. One or more motion sensitive MWD or other type of sensors carried by such a housing take measurement when the housing is stationary. The drilling systems of the present invention provide near continuous drilling and allow more accurate downhole measurements. Thrusters can allow drilling of deeper horizontal wellbores and stationary measurements provide more accurate information about the formation, which are critical to the recovery of hydrocarbons from subsurface formations.

Figure 6:
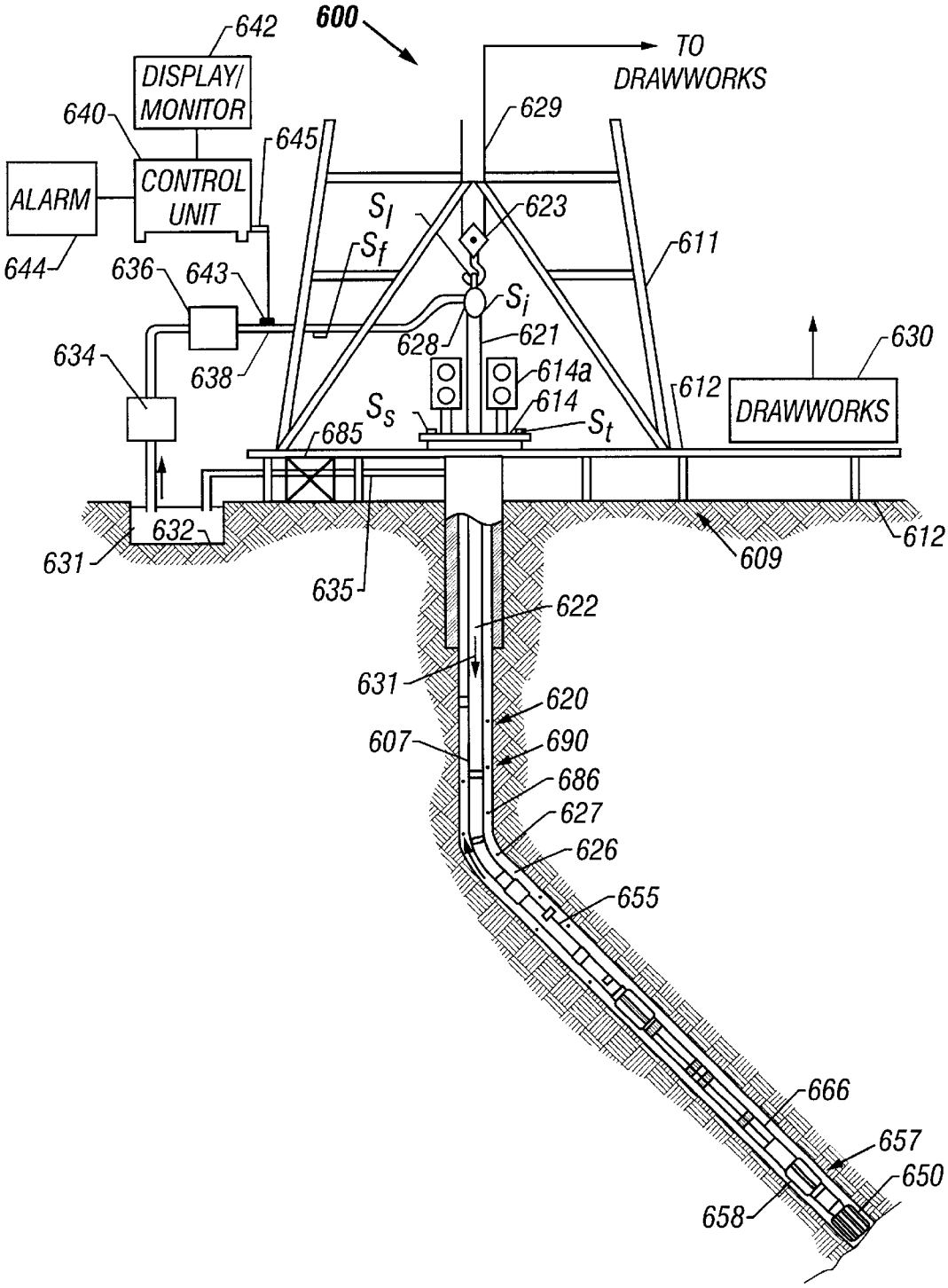
FIG. 6 is shows a drilling system that utilizes the drilling assemblies of FIGS. 1–5 for drilling wellbores.

FIG. 6 shows a schematic diagram of a an exemplary drilling system 600 that can utilize a drilling assembly 690 made according to an embodiment of the present invention. A drill string 620 that has the drilling assembly 690 attached to a bottom end thereof is conveyed in a borehole 626 by a tubing 607 from a surface location 609. The drilling system 600 includes a conventional derrick 611 erected on a floor 612 which supports a rotary table 614 that is rotated by a prime mover such as an electric motor (not shown) at a desired rotational speed. The drill string 620 includes a tubing (drill pipe or coiled-tubing) 622 extending downward from the surface 612 into the borehole 626. A drill bit 650, attached to the drill string 620 bottom end, disintegrates the geological formations when it is rotated to drill the borehole 626. The drill string 620 is coupled to a drawworks 630 via a kelly joint 621, swivel 628 and line 629 through a pulley 623. Drawworks 630 is operated to lower the drill pipe 622 and to control the hook board. A tubing injector 614*a* and a reel (not shown) are used instead of the rotary table 614 to inject the BHA into the wellbore when a coiled-tubing is used as the tubing 622. The operations of the drawworks 630 and the tubing injector 614*a* are known in the art and are thus not described in detail herein.

During drilling, a suitable drilling fluid 631 from a mud pit (source) 632 is circulated under pressure through the drill string 620 by a mud pump 634. The drilling fluid passes from the mud pump 634 into the drill string 620 via a desurger 636 and the fluid line 638. The drilling fluid 631 discharges at the borehole bottom 651 through openings in the drill bit 650. The drilling fluid 631 circulates to the surface though the annular space 627 between the drill string 620 and the borehole 626 and returns to the mud pit 632 via a return line 635 and drill cutting screen 685 that removes the drill cuttings 686 from the returning drilling fluid 631*b*. A sensor $S_f$ in line 38 provides information about the fluid flow rate. A surface torque sensor $S_t$ and a sensor $S_s$ associated with the drill string 620 respectively provide information about the torque and the rotational speed of the drill string 620. Tubing injection speed is determined from the sensor $S_i$, while the sensor $S_l$ provides the hook load of the drill string 620.

A downhole motor 655 (mud motor) is disposed in the drilling assembly 690 to rotate the drill bit 650. The ROP for a given BHA largely depends on the WOB or the trust force on the drill bit 650 and its rotational speed. The mud motor 655 is coupled to the drill bit 650 via a drive shaft 666 disposed in a bearing assembly 657. The mud motor 655 rotates the drill bit 650 when the drilling fluid 631 passes through the mud motor 655 under pressure. The bearing assembly 657 supports the radial and axial forces of the drill bit 650, the downthrust of the mud motor 655 and the reactive upward loading from the applied weight on bit. A lower stabilizer 658 coupled to the bearing assembly 657 acts as a centralizer for the lowermost portion of the drill string 620.

A surface control unit or processor 640 receives signals from the downhole sensors and devices via a sensor placed in the fluid line 638 and signals from other sensors used in the system 600 and processes such signals according to programmed instructions provided to the surface control unit 640. The surface control unit 640 displays desired drilling parameters and other information on a display/monitor 642 that is utilized by an operator to control the drilling operations. The surface control unit 640 contains a computer, memory for storing data, recorder for recording data and other necessary peripherals. The surface control unit 640 also may include a simulation model and processes data according to programmed instructions. The control unit 640 is preferably adapted to activate alarms 644 when certain unsafe or undesirable operating conditions occur. The surface control unit 640 communicates with the downhole controllers described above via a two way communication link. It can provide command signals to the downhole controller, alter the downhole stored programs and process data received from the downhole controllers. The downhole controllers and the surface controller 640 cooperate with each other to optimize the drilling of the wellbore.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. A drilling assembly for drilling a wellbore in a subsurface formation, comprising:

(a) a drill bit at an end of said drilling assembly;

(b) an upper and a lower force application device in series in the drilling assembly, each said upper and lower force application device alternately maintaining an associated outer slidable housing substantially stationary relative to the wellbore inside while applying force on the drill bit to continuously drill the wellbore; and (c) at least one sensor carried at least in part by one of said outer housings, said at least one sensor taking measurements downhole during drilling of the wellbore when the housing carrying the at least one sensor is stationary relative to the wellbore inside.

2. The drilling assembly of claim 1, wherein each said upper and lower force application device includes a separate locking device that engages with the wellbore inside to maintain its associated slidable housing stationary.

3. The drilling assembly of claim 1, wherein each force application device is operated by one of (i) a hydraulic power unit, (ii) an electric motor, and (iii) an electromechanical device.

4. The drilling assembly of claim 1, wherein the at least one sensor is selected from a group consisting of (i) a nuclear magnetic resonance sensor (ii) a formation testing device, (iii) a direction measuring device that includes at least one gyroscope, (iv) an acoustic sensor, (v) a gamma ray device, and (vi) a nuclear sensor for determining a property of the formation.

5. The drilling assembly of claim 1, wherein the at least one sensor includes a nuclear magnetic resonance sensor that comprises:

(i) a magnet system that induces a static magnetic fluid in the formation surrounding the wellbore;

(ii) a radio frequency antenna that transmits radio frequency signals at a particular frequency normal to the static magnetic field in a region of investigation in the formation; and (iii) a processor for processing response signals to the radio frequency signals to determine a property of the formation.

6. The drilling assembly of claim 1, wherein the at least one sensor includes a formation testing device.

7. The drilling assembly of claim 6, wherein the formation testing device includes at least one of:

(i) a sample collection device that collects a sample of a fluid from the formation when the housing carrying said sample collection device is stationary relative to the wellbore inside; and (ii) a measurement device that determines a parameter of the formation fluid.

8. The drilling assembly of claim 7, wherein the parameter of formation fluid is selected from a group consisting of (i) an acoustic property of the formation fluid, (ii) pressure, (iii) temperature, (iv) a physical property of the formation fluid, and (v) a chemical property of the formation fluid.

9. The drilling assembly of claim 1, wherein the at least one sensor includes an acoustic measurement-while-drilling device that comprises at least one acoustic transmitter that transmits acoustic signals into the formation and at least one acoustic detector spaced apart from the acoustic detector that detects acoustic signals propagated through the formation, and a signal processing unit that processes the detected signals for determining a parameter of interest.

10. The drilling assembly of claim 1 further comprising a steering device downhole of the force application device, said steering device selectively applying force to the wellbore inside to steer the drill bit in a particular direction.

11. The drilling assembly of claim 10, wherein the steering device comprises a plurality of independently controlled ribs, each said rib capable of extending outward from the drilling assembly to apply a different amount of force on the wellbore inside.

12. The drilling assembly of claim 10, wherein the steering device includes a control unit that controls the force applied by each said rib on the wellbore inside to maintain the drilling of the wellbore along a predetermined wellbore path.

13. The drilling assembly according to claim 1 further comprising at least one additional sensor that provides measurements relating to the determination of the direction of said drilling assembly relative to a known position.

14. The drilling assembly according to claim 13, wherein the at least one additional sensor includes at least one of (i) an inclinometer, (ii) a gamma ray device, (iii) a magnetometer, (iv) an accelerometer, and (v) gyroscopic device.

15. The drilling assembly of claim 1 further comprising a coupling device that selectively enables coupling and decoupling of the drilling assembly to a rotating member.

16. The drilling assembly of claim 1 wherein the measurements of said at least one sensor are sensitive to movement of the at least one sensor along the wellbore.

17. A drilling assembly for drilling a wellbore in a subsurface formation, comprising:

(a) a drill bit at an end of said drilling assembly;

(b) a force application device capable of continuously applying force on the drill bit to move the drill bit in the wellbore to drill said wellbore; and (c) a slidable assembly uphole of the force application device having a slidable drill collar, said drill collar having a locking device, wherein the locking device engages the drill collar with the wellbore inside to maintain the drill collar stationary relative to the wellbore while the force application device travels a predetermined distance from an initial position in the wellbore and thereafter disengages from the wellbore inside and allows the drill collar to move toward the force application device by the predetermined distance, wherein the force application device includes a traction device that continuously moves while being engaged with the wellbore wall to continuously apply force on the drill bit.

18. The drilling assembly of claim 17, wherein the traction device includes a plurality of continuous motion rollers that engage with the wellbore inside to provide traction force to the drilling assembly.

19. The drilling assembly of claim 17, wherein the force application device is operated by one of (i) a hydraulic power unit, (ii) an electric motor, and (iii) an electromechanical device.

20. The drilling assembly of claim 17 further comprising at least one sensor whose measurements are sensitive to movement of the sensor in the wellbore, said at least one sensor being carried at least in part by the drill collar, said at least one sensor taking measurements downhole during drilling of the wellbore when the drill collar portion is stationary relative to the wellbore.

21. The drilling assembly of claim 20, wherein the at least one sensor is selected from a group consisting of (i) a nuclear magnetic resonance sensor (ii) a formation testing device, (iii) a direction measuring device that includes at least one gyroscope, (iv) an acoustic device, and (v) a gamma ray device.

22. The drilling assembly of claim 20, wherein the at least one sensor includes a nuclear magnetic resonance sensor that comprises:

(i) a magnet system that induces a static magnetic field in the formation surrounding the wellbore;

(ii) a radio frequency antenna that generates radio frequency signals at a particular frequency normal to a portion of the static magnetic field in a region of investigation in the formation; and (iii) a processor that processes signals responsive to the radio frequency signals to determine a characteristic of the formation.

23. The drilling assembly of claim 20, wherein the at least one sensor includes a formation testing device to provide measurements for a property of the formation fluid.

24. The drilling assembly of claim 23, wherein the property of the fluid is selected from a group consisting of (i) an acoustic property of the collected sample, (ii) pressure, (iii) temperature, (iv) a physical property of the collected sample, and (v) a chemical property of the collected sample.

25. The drilling assembly of claim 17 further comprising a steering device downhole of the force application device, said steering device selectively applying force to the wellbore inside to steer the drill bit in a preselected direction.

26. The drilling assembly of claim 17, wherein the drill collar portion slides over a piston disposed inside the drilling collar portion.

27. The drilling assembly of claim 17 further comprising a coupling device that enables a drill pipe connected to the drilling assembly to engage with and disengage from a rotating member.

28. A drilling assembly for drilling a wellbore in a subsurface formation, comprising:

(a) a drill bit at an end of said drilling assembly;

(b) a force application device capable of continuously applying force on the drill bit to move the drill bit in the wellbore to drill said wellbore;

(c) a slidable assembly uphole of the force application device having a slidable drill collar, said drill collar having a locking device, wherein the locking device engages the drill collar with the wellbore inside to maintain the drill collar stationary relative to the wellbore while the force application device travels a predetermined distance from an initial position in the wellbore and thereafter disengages from the wellbore inside and allows the drill collar to move toward the force application device by the predetermined distance; and (d) a steering device downhole of the force application device, said steering device selectively applying force to the wellbore inside to steer the drill bit in a preselected direction, wherein the steering device comprises a plurality of independently controlled ribs, each said rib capabled of extending outward from the drilling assembly to apply a different amount of force on the wellbore inside.

29. The drilling assembly of claim 28, wherein the steering device includes a control unit that controls the force applied by each said rib on the wellbore inside to maintain the drilling of the wellbore along a predetermined wellbore path.

30. A method of forming a wellbore in a subsurface formation, comprising:

(a) providing a drill bit at an end of a drilling assembly having an upper and lower force application device, the force application devices each having an associated outer slidable housing;

(b) locking, in an alternating fashion, the upper and lower outer slidable housing to the wellbore, to thereby maintain at least one of the outer housings substantially stationary relative to the wellbore while applying force on the drill bit to continuously drill the wellbore;

(c) providing at least one sensor on one of the outer housings; and (d) taking measurements during drilling of the wellbore with the at least one sensor when the housing carrying the at least one sensor is stationary relative to the wellbore.

31. The method of claim 30, wherein said locking step includes activating a locking device that engages with the wellbore inside to maintain an associated slidable housing substantially stationary.

32. The method of claim 30 further comprising applying applying force to the wellbore inside to steer the drill bit in a particular direction.

33. The method of claim 32, wherein the force is applied by a plurality of independently controlled ribs, each said rib capable of extending outward from the drilling assembly to apply a different amount of force on the wellbore inside.

34. The method of claim 33 further comprising controlling the force applied by each said rib on the wellbore to maintain the drilling of the wellbore along a predetermined wellbore path.

35. A drilling system for drilling a wellbore in a subsurface formation, comprising:

(a) a derrick;

(b) a drill string including tubing, said drill string being conveyed from said derrick into the wellbore;

(c) a drilling assembly associated with said drill string;

(c) a drill bit at an end of said drilling assembly;

(d) an upper and a lower force application device in series in said drilling assembly, each said upper and lower force application device alternately maintaining an associated outer slidable housing stationary relatively to the wellbore inside while applying force on the drill bit to continuously drill the wellbore; and (c) at least one sensor whose measurements are sensitive to movement of the at least one sensor along the wellbore, said at least one sensor carried at least in part by one of said outer housings, said at least one sensor taking measurements downhole during drilling of the wellbore when the housing carrying the at least one sensor is stationary relative to the wellbore inside.

36. The drilling system of claim 35, wherein each said upper and lower force application device includes a separate locking device that engages with the wellbore inside to maintain its associated slidable housing stationary.

37. The drilling system of claim 35 further comprising a steering device downhole of the force application device, said steering device selectively applying force to the wellbore inside to steer the drill bit in a particular direction.

38. The drilling system of claim 37, wherein the steering device comprises a plurality of independently controlled ribs, each said rib capable of extending outward from the drilling assembly to apply a different amount of force on the wellbore inside.

39. The drilling system of claim 38, wherein the steering device includes a control unit that controls the force applied by each said rib on the wellbore inside to maintain the drilling of the wellbore along a predetermined wellbore path.

40. A method for drilling a wellbore in a subsurface formation, comprising:

(a) providing a drill bit at an end of a drilling assembly;

(b) engaging the wellbore wall with a traction device associated with a force application device on the drilling assembly, the traction device continuously moving toward the drill bit while being engaged with the wellbore wall to continuously apply force on the drill bit;

(c) providing a slidable assembly uphole of the force application device having a slidable drill collar, the drill collar having a locking device;

(d) engaging the drill collar with the wellbore inside with the locking device to maintain the drill collar substantially stationary relative to the wellbore while the force application device travels a predetermined distance from an initial position in the wellbore; and (e) disengaging the drill collar from the wellbore wall to thereby allow the drill collar to move toward the force application device by the predetermined distance.

41. The method of claim 40, wherein the traction device includes a plurality of continuous motion rollers that engage with the wellbore inside to provide traction force to the drilling assembly.

42. The method of claim 40 further comprising steering the drill bit in a preselected direction with a steering device positioned downhole of the force application device, the steering device selectively applying force to the wellbore.

43. A method for drilling a wellbore in a subsurface formation, comprising:

(a) providing a drill bit at an end of a drilling assembly;

(b) applying a substantially continuous force on the drill bit with a force application device to move the drill bit in the wellbore to drill the wellbore;

(c) providing a slidable assembly uphole of the force application device having a slidable drill collar, the drill collar having a locking device;

(d) engaging the drill collar with the wellbore inside using the locking device to maintain the drill collar substantially stationary relative to the wellbore while the force application device travels a predetermined distance from an initial position in the wellbore;

(e) disengaging the drill collar from the wellbore wall to thereby allow the drill collar to move toward the force application device by the predetermined distance; and (f) steering the drill bit in a preselected direction with a steering device downhole of the force application device, the steering device selectively applying force to the wellbore inside, wherein the steering device comprises a plurality of independently controlled ribs, each rib capable of extending outward from the drilling assembly to apply a different amount of force on the wellbore inside.

44. The method of claim 43 further comprising controlling the steering device with a control unit that controls the force applied by each said rib on the wellbore inside to maintain the drilling of the wellbore along a predetermined wellbore path.

45. A drilling system for drilling a wellbore in a subsurface formation, comprising:

(a) a derrick;

(b) a drill string including tubing, said drill string being conveyed from said derrick into the wellbore;

(c) a drilling assembly associated with said drill string;

(d) a drill bit at an end of said drilling assembly;

(e) a force application device capable of continuously applying force on the drill bit to move the drill bit in the wellbore to drill said wellbore; and (f) a slidable assembly uphole of the force application device having a slidable drill collar, said drill collar having a locking device, wherein the locking device engages the drill collar with the wellbore inside to maintain the drill collar stationary relative to the wellbore while the force application device travels a predetermined distance from an initial position in the wellbore and thereafter disengages from the wellbore inside and allows the drill collar to move toward the force application device by the predetermined distance, wherein the force application device includes a traction devices that continuously moves while being engaged with the wellbore wall to continuously apply force on the drill bit.

46. The drilling system of claim 45, wherein the traction device includes a plurality of continuous motion rollers that engage with the wellbore inside to provide traction force to the drilling assembly.

47. A drilling system for drilling a wellbore in a subsurface formation, comprising:

(a) a derrick;

(b) a drill string including tubing, said drill string being conveyed from said derrick into the wellbore;

(c) a drilling assembly associated with said drill string;

(d) a drill bit at an end of said drilling assembly;

(e) a force application device capable of continuously applying force on the drill bit to move the drill bit in the wellbore to drill said wellbore;

(f) a slidable assembly uphole of the force application device having a slidable drill collar, said drill collar having a locking device, wherein the locking device engages the drill collar with the wellbore inside to maintain the drill collar stationary relative to the wellbore while the force application device travels a predetermined distance from an initial position in the wellbore and thereafter disengages from the wellbore inside and allows the drill collar to move toward the force application device by the predetermined distance; and (g) a steering device downhole of the force application device, said steering device selectively applying force to the wellbore inside to steer the drill bit in a preselected direction, wherein the steering device comprises a plurality of independently controlled ribs, each said rib capable of extending outward from the drilling assembly to apply a different amount of force on the wellbore inside.

48. The drilling assembly of claim 47, wherein the steering device includes a control unit that controls the force applied by each said rib on the wellbore inside to maintain the drilling of the wellbore along a predetermined wellbore path.

* * * * *